US005685271A

United States Patent [19]

Taomo et al.

[11] Patent Number: 5,685,271

[45] Date of Patent: Nov. 11, 1997

[54] HAND LEVER DEVICE

[75] Inventors: Toshio Taomo, Tokyo; Hisato Ohsawa, Hamura; Hirofumi Yamami, Akishima; Fumihiko Aiyama, Musashimurayama, all of Japan

[73] Assignee: Kioritz Corporation, Tokyo, Japan

[21] Appl. No.: 669,224

[22] Filed: Jun. 24, 1996

[30] Foreign Application Priority Data

Jun. 23, 1995 [JP] Japan ..... 7-158237

[51] Int. Cl.[6] ..... F02D 9/00; F02D 11/02

[52] U.S. Cl. ..... 123/398; 74/500.5

[58] Field of Search ..... 123/398, 400, 123/403; 74/489, 500.5, 501.5 R, 501.6, 502.2, 502.4, 502.6; 30/381, 382, 383, 388, 389; 56/10.5

[56] References Cited

U.S. PATENT DOCUMENTS

| | | | |
|---|---|---|---|
| 4,309,862 | 1/1982 | Carlson | 56/10.5 |
| 4,570,593 | 2/1986 | Take et al. | 123/398 |
| 4,798,185 | 1/1989 | Driggers | 123/400 |
| 4,898,039 | 2/1990 | Aiyama et al. | 30/382 |
| 5,131,363 | 7/1992 | Ganser | 123/398 |
| 5,517,967 | 5/1996 | Nakayama | 123/398 |

*Primary Examiner*—Willis R. Wolfe

*Attorney, Agent, or Firm*—Cushman Darby & Cushman IP Group of Pillsbury Madison & Sutro LLP

[57] ABSTRACT

A hand lever device is disclosed for adjusting the degree of openness of a throttle valve via a cable and kept at a desired opening degree and yet immediately returned to a minimum degree of opening to ensure high safety, thereby diminishing fatigue of fingers, and ensuring a desired level of operation. The hand lever device comprises a main lever (3) and a sub-lever (50) is attached to a wind-up tractive member (60) which draws a cable (20) connected to a driven member (CV) in such a manner that one end portion of the cable (20) is wound up thereon, and a torsion coil spring (40) is used as a brake operated by the main lever (30) for braking the wind-up tractive member (60) in order to hold the sub-lever (50) immobilized at any pivotally operated position.

4 Claims, 4 Drawing Sheets

HAND LEVER DEVICE

BACKGROUND OF THE INVENTION

1. Field of the Invention

The present invention relates to a hand lever device for operating a drive member, such as a throttle valve, of an internal combustion engine via a cable. In particular, the hand lever is preferably mounted on a working machine, such as a hedge trimmer or brush cutter, in the vicinity of a hand grip so that it is easy and convenient to operate such a throttle valve or the like via a throttle cable or the like.

2. Description of the Prior Art

For example, in a working machine such as a hedge trimmer and brush cutter which comprises an operative portion including a cutting blade or similar member driven by an internal combustion engine, a hand lever device is employed for controlling the speed of the engine by adjusting the throttle valve of the engine. The hand lever is mounted in the vicinity of a U-shaped handle, or where the bar handle of the working machine is gripped so as to permit manual control of the internal combustion engine.

The hand lever device is generally provided with a throttle trigger or lever operated by an operator's fingers with the throttle lever being pivotally operated to thereby control the degree of opening of the throttle valve via a throttle cable. In general, the throttle valve is always biased toward the direction of minimum valve opening that allows the engine to idle. Accordingly, the throttle valve is normally kept at an idle opening setting and, when the throttle cable is drawn, the valve begins to open from the idle setting toward an opening setting for high speed operation.

Such hand lever devices for controlling throttle valve settings have been known to include an automatic return to an idle setting. Consequently, when such a throttle lever is released from a pivotally operated position, the lever is automatically returned to its original idle position setting thereby restoring the throttle valve to its idle setting. Conversely, such a hand lever could be of an immobilizable type such that when fingers are released from a throttle lever, the throttle lever will be held immobilized at a desired pivotally operated position (see Japanese Examined Utility Model Publication No. 19944/1982, etc.).

In the auto-return type, when fingers are released from the throttle lever, the engine is automatically returned to an idling condition. Consequently, when the auto-return type is used in a working machine, where the output force of the engine is transmitted to an operative portion including a cutting blade via a centrifugal clutch, the centrifugal clutch is disconnected to cut off the transmission of the driving force to the operative portion. Accordingly, the operation of the machinery can immediately be stopped by returning the throttle valve to the opening degree for idle rotation if an accident occurs, thereby advantageously attaining improved safety. On the other hand, the throttle valve must be held continuously by fingers at a desired pivotally operted position to achieve desired operation of the machinery. This causes problems in that this type is awkward with respect to intermediate opening degrees, the fingers are susceptible to fatigue, and the achieved amount of rotational speed is likely to be unstable.

In contrast thereto, the immobilizable type is capable of solving the above problems associated with the auto-return to idle rotation opening degree type arrangements. The immobilization type approach advantageously holds the throttle lever at a desired pivotally operated position without being held by the operator's fingers. That operation is performed because the fingers are liberated from holding it. However, since additional operation is required to release the throttle lever from the immobilization position, it is impossible to immediately stop the machinery even if an accident is caused or occurs. Accordingly, there is a problem, in terms of safety, with the immobilizable type controller being inferior to the auto-return type controller.

SUMMARY OF THE INVENTION

The present invention has been made in view of these problems. It is, therefore, an object of the present invention to provide a hand lever device having a relatively simple structure, to appropriately adjust a throttle valve in its opening degree, such as via a cable, and kept at a desired opening degree and yet immediately returned to the opening setting to an idle condition to ensure high safety. This diminishes fatigue of fingers and helps assure that the preferred operability can be attained.

To achieve the above-mentioned objectives, the hand lever device according to the present invention, as a basic embodiment, comprises both a main lever and a sub-lever which are pivotally operated.

The sub-lever is attached to a wind-up tractive member which draws a cable connected to a driven member in such a manner that one end of the cable is wound up thereon. A torsion coil spring is used as a brake, operated by the main lever, to hold the wind-up tractive member in order to hold the sub-lever immobilized at any pivotally operated position.

As preferred embodiments of the present invention, there may be mentioned one wherein the brake operates when drawn by a slider of a slide link of a toggle mechanism with the main lever functioning as its swinging link, and one wherein the drive member is a throttle valve of an internal combustion engine.

Where the driven member is a throttle valve of an internal combustion engine, the hand lever device is disposed adjacent the handle of a working machine that includes a cutting blade driven by an internal combustion engine. The engine is controlled by a throttle valve biased to an opening degree that permits an idle condition so that when a throttle cable connected thereto is drawn from a non-operating position, the throttle valve begins to open from the opening position for the idle condition. In a more preferred form the device comprises pivotally operated main and sub-levers. The sub-lever is unitedly fixed to a wind-up tractive member which draws a cable connected to a driven member in such a manner that one end portion of the cable is wound up thereon. A coiled portion of a torsion coil spring, one end of which is hook-wise fixed, is circumferentially fitted over the wind-up tractive member. The wind-up tractive member is held immobilized at any pivotally operated position against the tractive force of the throttle cable by frictional force between the wind-up tractive member and the torsion coil spring generated by drawing the other end of the torsion coil spring by the main lever.

In the preferred form of the hand lever device, according to the present invention which is constructed as described above, when the main lever is pivoted to a set position close to the grip of the handle, the other end of the torsion coil spring is drawn to reduce the inner diameter of the torsion coil spring. Consequently, frictional force is generated between the wind-up tractive member and the torsion coil spring.

In this condition, while holding as by gripping, the main lever at the set position, the sub-lever can be pivoted against the frictional force between the wind-up tractive member and the torsion coil spring. By the pivotal operation of the sub-lever, the throttle cable is drawn or pulled thereby rotating the throttle valve from a minimum degree of opening (for an idle condition) in the opening direction, thus adjusting the degree of openness of the throttle valve. The internal combustion engine is thereby actuated at a desired operational speed.

In this connection, even if fingers are removed from the sub-lever, the sub-lever is held at the pivotally operated position by the frictional force generated between the wind-up tractive member and the torsion coil spring against the tractive force by the throttle cable. Accordingly, the throttle valve is kept at the adjusted degree of opening (the set opening degree), thereby enabling fatigue of the fingers to be relieved.

In this condition, even if the main lever is brought somewhat apart from the grip, for example, by moderately loosening the hold thereon in order to re-grip the main lever, the frictional force generated between the wind-up tractive member and the torsion coil spring by elastic force of the torsion coil spring itself enables the wind-up tractive member and the sub-lever to be held at the pivotally operated position against the tractive force of the throttle cable.

In the event that it is necessary to immediately lower the rotational speed of the engine due to the occurrence of an accident or the like, the main lever is completely released. This removes the frictional force between the wind-up tractive member and the torsion coil spring allowing the wind-up tractive member, the sub-lever, throttle cable and throttle valve to return to their respective original positions for a degree of opening that will permit an idle condition. In consequence, the engine is returned to its idle condition. Where an engine is operatively connected by such an arrangement to a cutting blade or other such device via a centrifugal clutch, the centrifugal clutch is disconnected to cut off the transmission of driving forces to the cutting blade or driven device, thereby immediately stopping the operation of the driven device.

Further, use of the main lever as a swinging link of a toggle mechanism, permits the main lever to be brought to a position closer to the set position and be held there with less force than would otherwise be required. Accordingly, even if the grip is held for a long period of time with the main lever at the set position, the fingers will be less tired.

DESCRIPTION OF THE PREFERRED EMBODIMENTS

The present invention will be described in more detail with reference to the accompanying drawings.

Figure 1:
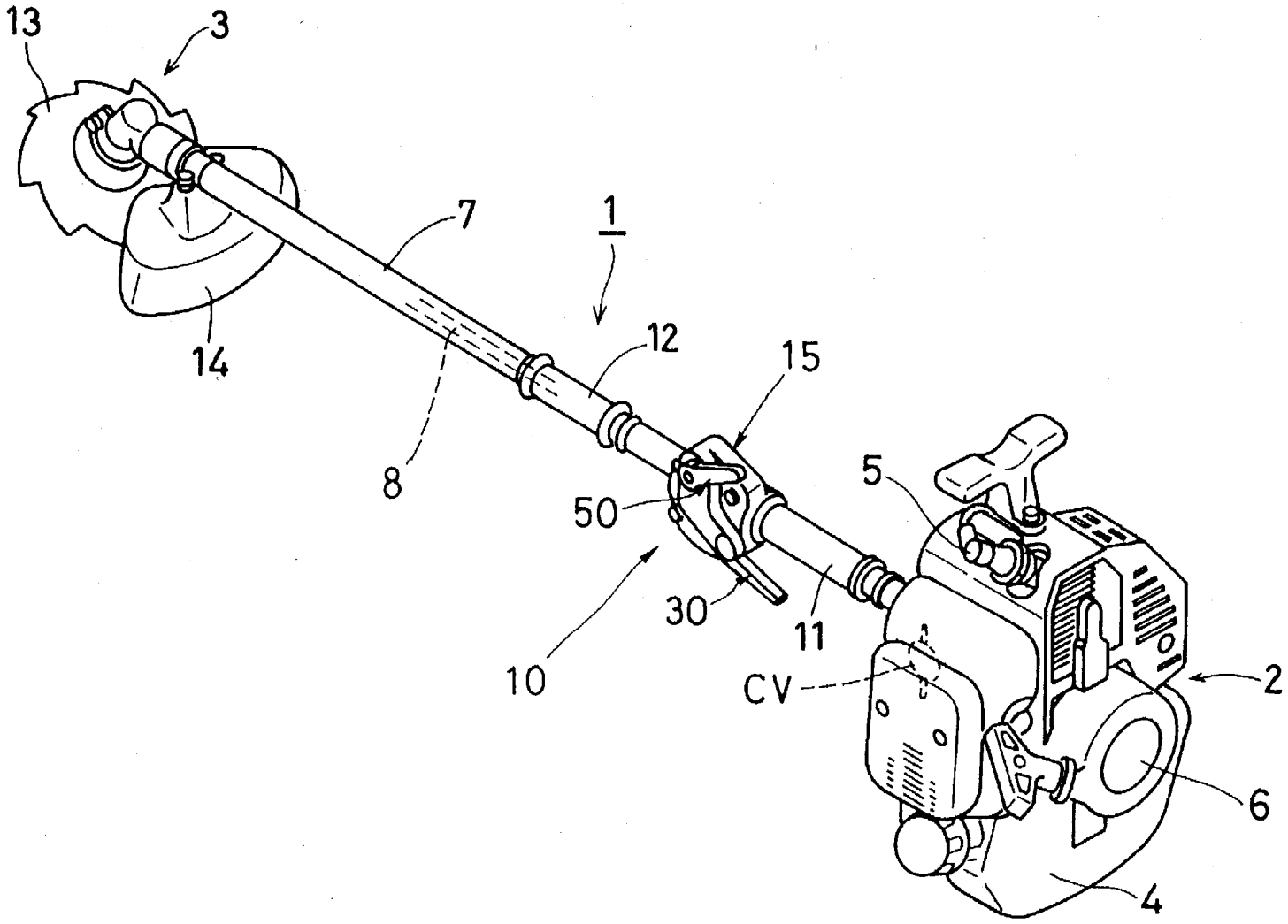
FIG. 1 is a perspective view showing an example of a brush cutter adopting one embodiment of the hand lever device according to the present invention.

FIG. 1 shows an example of a brush cutter employing one embodiment of the hand lever device according to the present invention. The illustrated brush cutter 1 comprises a bar handle (operating rod) 7 provided with grips 11, 12 spaced a predetermined distance apart, an operative portion or driven device 3, provided on the distal end of the bar handle 7 and which can include a cutting blade 13, a safety cover 14 or other rotationally driven device. The brush cutter 1 is powered by an internal combustion engine 2, for example, a small air-cooled two-cycle gasoline engine, which is disposed on the proximal end of the bar handle 7. The engine 2 provides the driving power for rotating the cutting blade 13 via a drive shaft 8 extending through and within the bar handle 7. The internal combustion engine 2 is provided with a carburetor (not shown) having a throttle valve CV and a spark plug 5.

In this example, the throttle valve CV is always biased in the direction of a minimum degree of opening (for an idle condition). When a throttle cable 20 (as shown in FIG. 2) connected thereto, which will be described below, is drawn from non-operating position, the throttle valve CV will be opened from that minimum idle opening position.

One embodiment of the hand lever device 10, according to the present invention, is provided in the vicinity of the rear grip 11, which is one of the grips 11 and 12 that is gripped generally by an operator's right hand. The hand lever device 10 is used to adjust the degree of opening of the throttle valve CV.

Figure 2:
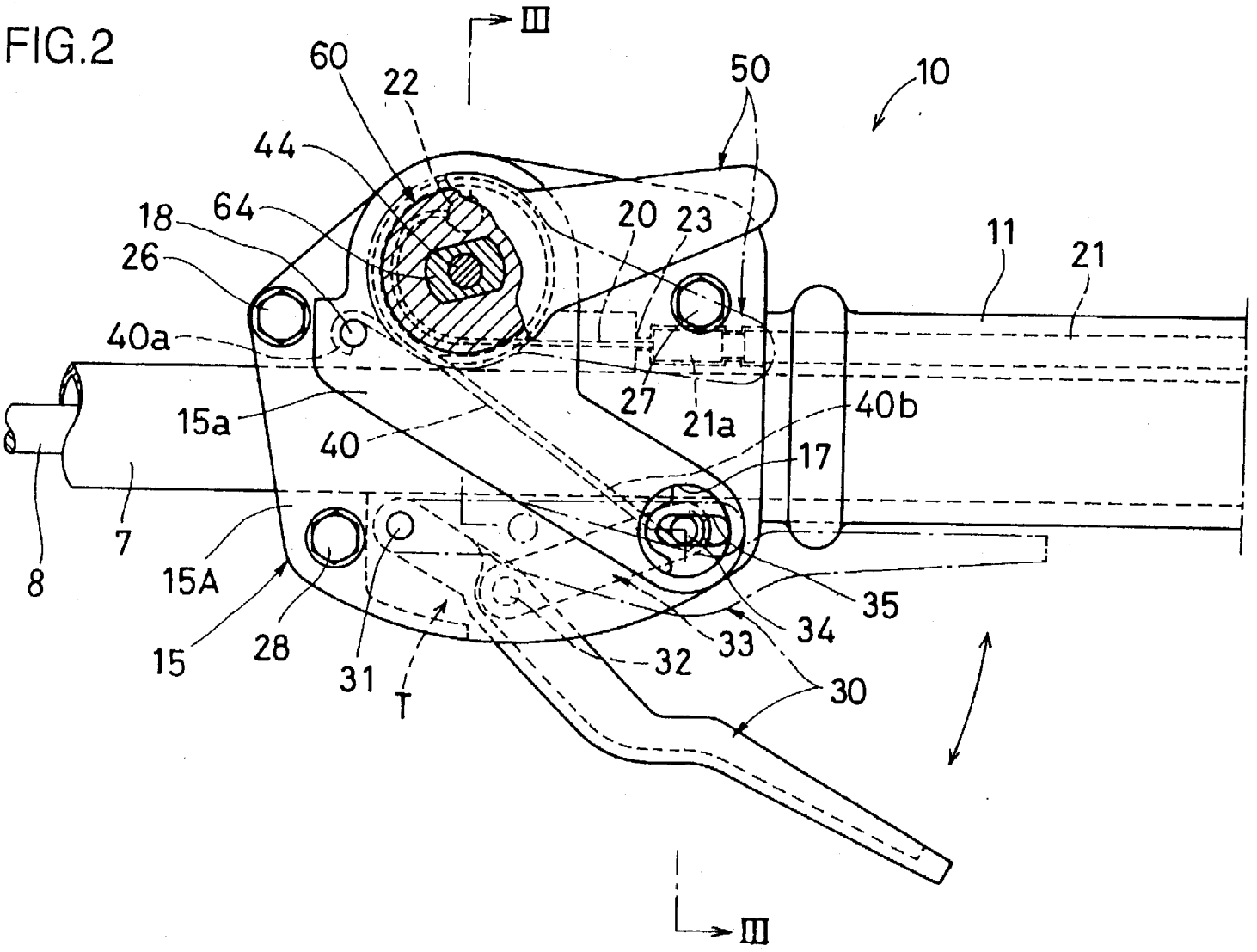
FIG. 2 is a partially cutaway left side view showing one embodiment of the hand lever device according to the present invention.
Figure 3:
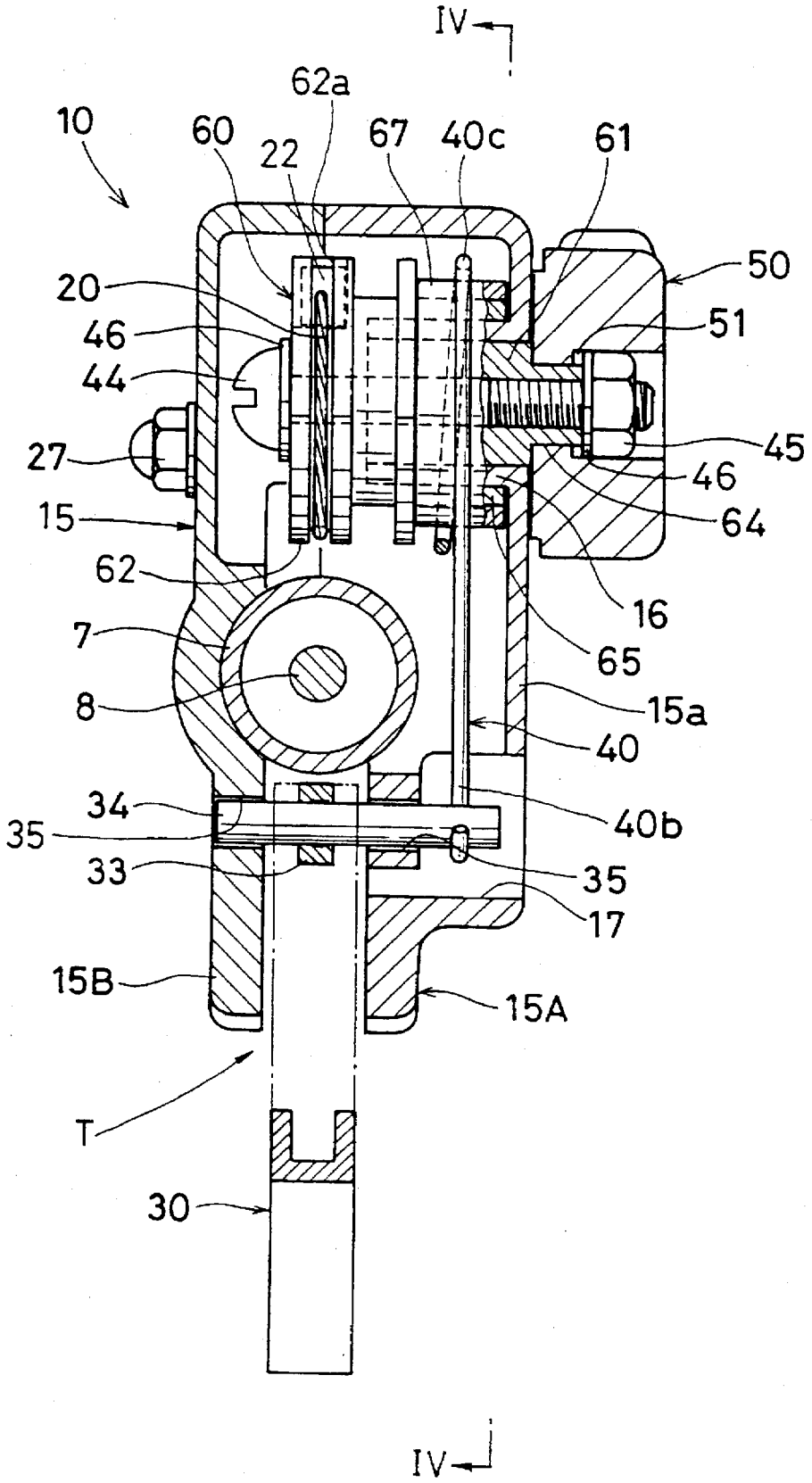
FIG. 3 is an enlarged sectional view taken along the line III—III and viewed in the direction of the arrows in FIG. 2.
Figure 4:
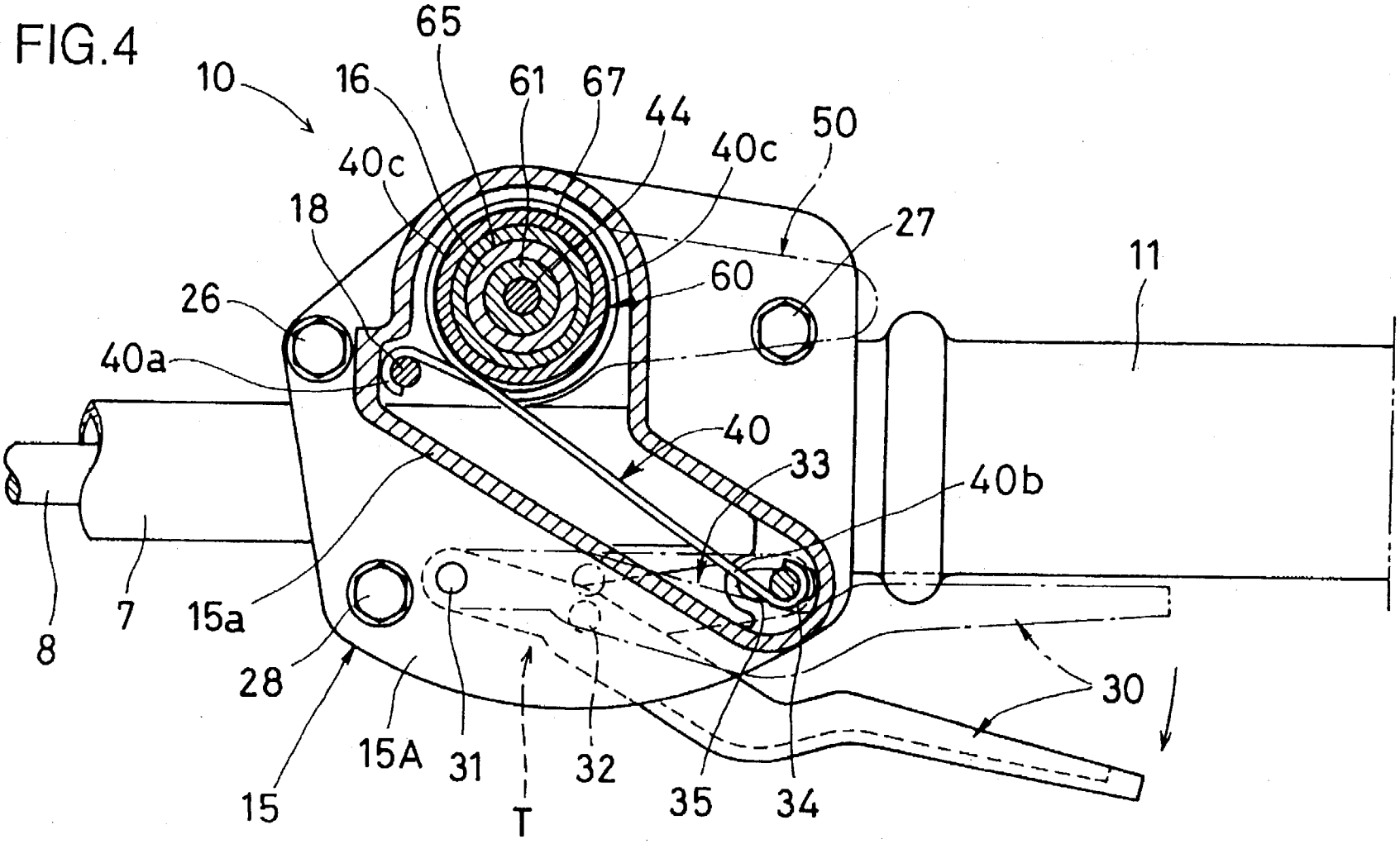
FIG. 4 is a sectional view taken along the line IV—IV and viewed in the direction of the arrows in FIG. 3.

As shown in FIGS. 2 to 4, the hand lever device 10 comprises a main lever 30, which is pivotally supported at its base end by a pin 31 and which has a substantially "boomerang-like" or "dog-legged" shaped, a wind-up tractive member 60, which will be described below, and a sub-lever 50 which is unitedly fixed to the opposite end of the pivotal axis of the wind-up tractive member 60. A housing 15 is provided for pivotally holding these components and is composed of right and left cover members 15A, 15B (hereinafter often referred to simply as cover case 15A, 15B), the former of which has an outwardly extending tray shaped protrusion 15*a*. The cover members 15A, 15B, fit around the bar handle 7 adjacent the rear grip 11. The housing 15 is fixedly mounted onto the bar handle 7, for example, by a clamping assortment or a combination of a bolt, a nut, a washer at three positions 26, 27 and 28.

As well seen with reference to FIG. 3, the cover member 15A is provided with an inwardly extending cylindrical bearing 16 and a pin portion 61 of the wind-up tractive member 60 is rotatably inserted in the bearing 16. A right end portion Of the pin portion 61 is provided with a pulley-like grooved wind-up portion 62, and a left end portion of the pin portion 61 has its sides parallelly cut off, as shown in FIG. 2, to provide a rotation-preventive fixing portion 64. The rotation preventive fixing portion 64 is fitted into a hollow portion 51 formed in the base end of the sub-lever 50, and the sub-lever 50 is unitedly fixed to the pin portion 61 by means of a screw 44 inserted along the axis of the wind-up tractive member 60, a nut 45 and washers 46. The wind-up tractive member 60 and the sub-lever 50 which are connected together are rotatably held in the bearing 16 and are supported thereby. A fitting sleeve 65, in the form of a cylinder with one end closed and which is loosely fitted over the bearing 16, is provided between the grooved wind-up portion 62 and the rotation-preventive fixing portion 64 of pin portion 61. A brake drum 67 is fitted by appropriate means, such as press-fitting, serration fitting or adhesion, over the fitting sleeve 65.

One end of a throttle cable 20, connected to the throttle valve CV of the internal combustion engine 2, is led between the cover members 15A and 15B and above the bar handle 7 with the other end being inserted through an outer tube 21 of a Bowden cable. The distal end of the outer tube 21 is fastened by a fastening means 23 provided in the cover 15A, 15B. The one end of the throttle cable 20 is reeved around the grooved wind-up portion 62 of the wind-up tractive member 60 and locked in place with a terminal metal piece 22, which is attached to the one end thereof, by being fitted in a locking notch 62A formed in the grooved wind-up portion 62.

A coiled portion 40*c* of a torsion coil spring 40 is loosely fitted around the brake drum 67 of the wind-up tractive member 60. The torsion coil spring 40 acts as a brake means. The front end 40*a*, shown in FIG. 2, is hooked on a retaining pin 18 in the protrusion 15*a* formed in the cover member 15A. The rear end 40*b* is hooked on a slide pin 34, as in FIGS. 2 and 3, which acts as a slider of a slider link 33 in a toggle mechanism T in which the main lever 30 functions as its swinging link end which will be further described below.

The toggle mechanism T, with the main lever 30 functioning as its swinging link, comprises the slide link 33 one end of which is pivotally connected to the main lever 30 by a pin 32 at a position relatively near the base end of the main lever 30, with the other end being pivotally mounted on the slide pin 34 which is inserted therethrough.

When the main lever 30 is gripped and operated by the fingers of a hand to pivotally move it from the complete release position, shown by the solid line in FIG. 2, to the set position close to the rear grip 11, shown in phantom in FIG. 2, the pin 32, as the joint between the main lever 30 and the slide link 33, is moved. Such movement moves slide link 33 from a position close to but below a straight line connecting the pin 31, pivotally supporting the base end of the main lever 30, and the slide pin 34, which is itself slidably inserted through elongated holes 35, 35 formed in the cover members 15A, 15B and extend horizontally in the longitudinal direction and have a predetermined length, to a raised position, shown in phantom in FIG. 2, in parallel with that same straight line. The slide pin 34 is itself moved in the elongated holes 35, 35 to the right or backwardly in FIG. 2. Consequently, the rear end 40*b* of the torsion coil spring 40 is drawn rearwardly to reduce the inner diameter of the coiled portion 40*c*, thereby pressing the coiled portion 40*c* against the brake drum 67.

In the hand lever device 10 of this embodiment constructed as described above, when the main lever 30 is pivoted from the complete release position, shown by the solid line in FIG. 2, to the set position (immediately short of dead point) close to the rear grip 11 of the bar handle 7, as shown in phantom in FIG. 2, the rear end 40*b* of the torsion coil spring 40 is drawn by the slide pin 34 of the toggle mechanism T, including the main lever 30, which reduces the inner diameter of the coiled portion 40*c* of the torsion coil spring 40. Consequently, the coiled portion 40*c* of the torsion coil spring 40 is pressed against the brake drum 67, and a predetermined frictional force is generated between the brake drum 67 of the wind-up tractive member 60 and the torsion coil spring 40.

In this condition, while holding (gripping) the main lever 30 at the set position, the sub-lever 50 can pivotally be operated against the frictional force between the brake drum 67 of the wind-up tractive member 60 and the torsion coil spring 40. By the pivotal operation of the sub-lever 50, in a clockwise direction viewed in FIG. 2, the throttle cable 20 is drawn and rotates the throttle valve CV from an opening position for an idle condition further open toward an operating position, thus adjusting the degree of opening of the throttle valve CV. The internal combustion engine 2 is thereby actuated at a desired operating or rotational speed.

In this connection, even if the fingers are removed from the sub-lever 50, the sub-lever 50 is kept immobilized still at the pivotally operated position by the frictional force between the brake drum 67 of the wind-up tractive member 60 and the coiled portion 40*c* of the torsion coil spring 40 against the tractive force by the throttle cable 20. Accordingly, the throttle valve CV is kept at the adjusted opening degree (set opening degree), thereby enabling fatigue of the fingers to be relieved.

In this condition, even if the main lever 30 is brought somewhat apart from the rear grip 11 as shown by the solid line in FIG. 4, for example, by moderately loosening the rear grip thereon in order to re-grip the main lever 30, enough frictional force is still generated between the brake drum 67 and the torsion coil spring 40 by elastic force of the torsion coil spring 40 itself to enable the wind-up tractive member 60 and the sub-lever 50 to be kept immobilized still at the pivotally operated position against the tractive force by the throttle cable 20.

It is to be noted that the sub-lever 50 may pivotally be moved by fingers while keeping the main lever 30 gripped to the utmost.

In the event that it is necessary to immediately lower the operational speed of the engine 2 due to occurrence of accident or the like, the main lever 30 is completely released. The frictional force between the brake drum 67 and the torsion coil spring 40 is thereby substantially removed to allow the wind-up tractive member 60, sub-lever 50, throttle cable 20 and throttle valve CV to return to the respective original positions for the degree of opening for the idle operating condition. In consequence, the engine 2 is brought into its idle condition. In the case of the working machine 1 adapted to be such that rotational driving force of the engine 2 is transmitted to the operative portion 3 including the cutting blade 13 and the like via a centrifugal clutch, the centrifugal clutch is rendered disconntective to cut off the transmission of the driving force to the operative portion 3, thereby immediately stopping the operation of the operative portion 3 including the cutting blade 13 and the like.

Further, by the use of the main lever 30 as a swinging link of the toggle mechanism T, less force is needed to hold the main lever 30 at a position close to the set position. Accordingly, even if the rear grip 11 is held for a long period of time with the main lever 30 at the set position, the fingers are not so tired.

The present invention has been described in detail with reference to the one embodiment. It is, however, to be understood that the present invention is by no means restricted to the illustrated embodiment and that various modifications may be made within the scope which does not depart from the spirit of the present invention as defined in the claims.

For example, in the above example, the hand lever device 10 according to the present invention is used to control opening degree of the throttle valve CV of the internal combustion engine 2. It is, however, to be noted that the hand lever device according to the present invention may, of course, be used in other applications than adjustment of opening degree of the throttle valve CV.

Further, the hand lever device as such may be used by mounting it on a U-shaped handle and the like beside the bar handle 7.

As understood from the above description, according to the hand lever device of the present invention, although it has a relatively simple structure, excellent effects are attained, for example, that the throttle valve as a driven member can be adjusted appropriately in its opening degree via the cable and kept at a desired opening degree and yet immediately returned to the opening degree for idle rotation to ensure high safety, that fatigue of fingers is diminished, and that preferable operability can be attained.

What is claimed is:

1. A hand lever device disposed in the vicinity of a grip of a handle of a working machine comprising a rotating member driven by an internal combustion engine provided with a throttle valve, said throttle valve being biased to a setting that will allow said engine to operate at an idle condition so that when a throttle cable connected thereto is pulled from such a position, the throttle valve begins to open to a greater degree, said hand lever device comprising a main lever and a sub-lever which are each pivotally operated, said sub lever being attached to a wind-up tractive member mounted within a housing, a throttle cable interconnected between said throttle valve and said wind-up tractive member, one end portion of said throttle cable being wound up on and fixed to said wind-up tractive member, a torsion coil spring having one end fixed circumferentially over said wind-up tractive member, the other end of said torsion coil spring being operatively attached to said main lever, whereby said wind-up tractive member is held immobilized at any pivotally operated position against the tractive force of said throttle cable by frictional force between said wind-up tractive member and said torsion coil spring generated by drawing said other end of said torsion coil spring by said main lever.

2. A hand lever device comprising a housing, a main lever and a sub-lever each pivotably attached to said housing for movement between first and second positions, a tractive member interconnected with said sub-lever, a cable connected between said tractive member and a driven member and a torsion coil spring operatively connected to said tractive member, said main lever being operatively connected to said torsion coil spring so that said torsion coil spring applies a brake force to said tractive member as said main lever is pivoted from said first toward said second position thereby holding said sub-lever at any pivotally operated position.

3. The hand lever device according to claim 2, wherein the torsion coil spring is adapted to operate when pulled by a slider of a slide link of a toggle mechanism with said main lever functioning as a swinging link in said toggle mechanism.

4. The hand lever device according to claim 2 or 3; wherein the driven member is a throttle valve of an internal combustion engine.

* * * * *